US009187911B2

(12) United States Patent
Bowman

(10) Patent No.: US 9,187,911 B2
(45) Date of Patent: Nov. 17, 2015

(54) DECK DRAINAGE SYSTEMS

(71) Applicant: Southeastern Underdeck Systems, LLC, Buford, GA (US)

(72) Inventor: Heath Harold Bowman, Buford, GA (US)

( * ) Notice: Subject to any disclaimer, the term of this patent is extended or adjusted under 35 U.S.C. 154(b) by 0 days.

(21) Appl. No.: 14/258,861

(22) Filed: Apr. 22, 2014

(65) Prior Publication Data

US 2015/0300014 A1 Oct. 22, 2015

(51) Int. Cl.
*E04D 13/04* (2006.01)
*E04F 15/02* (2006.01)

(52) U.S. Cl.
CPC ..... *E04F 15/02183* (2013.01); *E04D 13/0477* (2013.01); *E04D 13/0481* (2013.01)

(58) Field of Classification Search
CPC ..... E04D 13/0477; E04D 13/0481; E04F 15/02183
See application file for complete search history.

(56) References Cited

U.S. PATENT DOCUMENTS

| | | | | | |
|---|---|---|---|---|---|
| 3,759,007 | A * | 9/1973 | Thiele | 52/533 |
| 4,091,588 | A * | 5/1978 | Heirich | 52/478 |
| 4,109,437 | A * | 8/1978 | Player et al. | 52/536 |
| 4,192,117 | A * | 3/1980 | Heirich | 52/478 |
| 4,522,007 | A * | 6/1985 | Oehlert | 52/506.1 |
| 4,918,898 | A * | 4/1990 | McLeod, Jr. | 52/588.1 |
| 5,511,351 | A * | 4/1996 | Moore | 52/302.1 |
| 5,524,409 | A * | 6/1996 | Kaiser | 52/588.1 |
| 6,164,019 | A * | 12/2000 | Salley | 52/11 |
| 6,226,941 | B1 * | 5/2001 | Stevens | 52/302.3 |
| 6,385,931 | B1 * | 5/2002 | Risser | 52/302.1 |
| 6,415,571 | B2 * | 7/2002 | Risser | 52/302.1 |
| 6,688,059 | B1 * | 2/2004 | Walker | 52/302.3 |
| 7,051,485 | B2 * | 5/2006 | Burnette | 52/578 |
| 7,584,580 | B1 * | 9/2009 | Adair et al. | 52/309.1 |
| 7,950,201 | B1 * | 5/2011 | Adair et al. | 52/748.1 |
| 8,082,712 | B1 * | 12/2011 | Butler et al. | 52/302.1 |
| 8,250,821 | B1 * | 8/2012 | Gibson | 52/302.3 |
| 8,291,677 | B2 * | 10/2012 | Adair et al. | 52/748.1 |
| 8,522,499 | B2 * | 9/2013 | Manson | 52/302.4 |
| 2001/0029706 | A1 * | 10/2001 | Risser | 52/11 |
| 2005/0252151 | A1 * | 11/2005 | Kindred | 52/650.3 |
| 2009/0266018 | A1 * | 10/2009 | Stockton | 52/302.3 |

* cited by examiner

*Primary Examiner* — Andrew J Triggs
(74) *Attorney, Agent, or Firm* — Thomas|Horstemeyer, LLP

(57) ABSTRACT

Disclosed are various embodiments of deck drainage systems. In some embodiments, the deck drainage system comprises a floor panel that is configured to be positioned under a deck platform. The floor panel may comprise a floor, a side that extends from the floor, and an overhang that extends from the side. The overhang may be configured to be disposed over another overhang of another floor panel. The end section may be configured to be adjacent to a distal edge of the other overhang. The deck drainage system may further comprise a hanger that is configured to be suspended from the deck platform. The hanger may form a slot into which the end section of the overhang of the floor panel is configured to be inserted.

17 Claims, 3 Drawing Sheets

DECK DRAINAGE SYSTEMS

BACKGROUND

An outdoor deck may comprise multiple floor members, such as wooden boards. The floor members may form a platform that is elevated above the ground. The deck may provide an outdoor space for entertaining guests or other purposes.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

The platform of a deck may be formed of decking or multiple floor members, such as wooden boards, that are arranged in a substantially planar fashion. Spacings may exist between the floor members that form the platform. As such, if the deck is exposed to a liquid, such as but not limited to rain, a spilled drink, or water from a leaking hose, the liquid may pass through the deck via the spacings or other openings in the deck. The liquid may fall from the deck onto people or property that located beneath the deck. Additionally, the liquid that falls from the deck may drain and collect in an area and cause problems.

The present disclosure is directed towards deck drainage systems that may be positioned under the platform of the deck, or under the decking, joists and/or girders from which a deck is constructed. Such deck drainage systems may receive and channel liquid that has fallen from the deck to a predetermined location. As will be described in further detail below, various embodiments of the present disclosure employ panels that reduce or even eliminate leakage due to wicking that could otherwise occur between the panels. Additionally, the design of the panels facilitates replacement of individual panels, if needed. Furthermore, some embodiments of the present disclosure may reduce the amount of liquid that would otherwise splash out of the deck drainage system.

Figure 1:
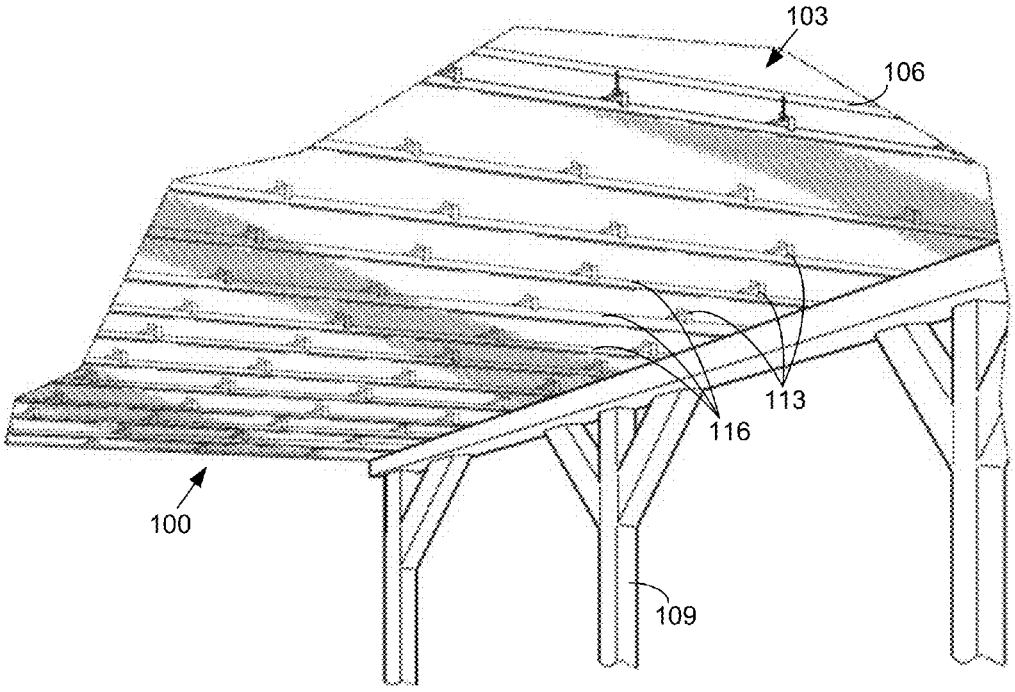
FIG. 1 is a drawing of portions of a deck drainage system according to various embodiments of the present disclosure.

With reference to FIG. 1, shown is a deck drainage system 100 according to various embodiments of the present disclosure. In particular, shown is the deck drainage system 100 attached to a deck 103. The deck 103 in the embodiment shown in FIG. 1 comprises a platform 106 that is elevated above the ground by supports 109. As discussed above, the platform 106 may be formed of multiple floor members, such as wooden boards or any other suitable floor members, that are arranged in a planar fashion.

The deck drainage system 100 may include one or more hangers 113, one or more floor panels 116, and/or other components. It is noted that only some of the hangers 113 and floor panels 116 illustrated in FIG. 1 are labeled for purposes of clarity. As will be discussed in more detail below, the hangers 113 may be suspended from the platform 106 of the deck 103, and the floor panels 116 may be attached to the hangers 113 and thus suspended below the platform 106.

When liquid falls through spacings or other openings of the platform 106, the liquid may fall onto the floor panels 116 instead of falling directly to the ground. Additionally, the floor panels 116 may be configured so that the liquid is channeled by the floor panels 116 in a particular direction. For example, the floor panels 116 may channel the liquid towards one or more gutters, downspouts or other suitable conduits for the liquid. Thus, the deck drainage system 100 may prevent liquid from falling from the deck 103 onto people or property located below the deck 103.

Figure 2:
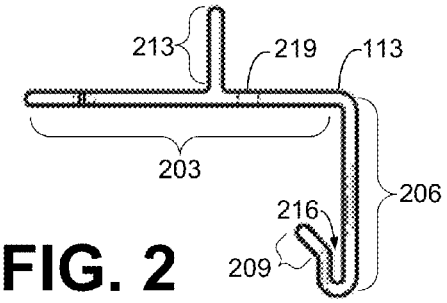
FIG. 2 is a drawing of a hanger for the deck drainage system of FIG. 1 according to various embodiments of the present disclosure.

With reference to FIG. 2, shown is the hanger 113 according to various embodiments of the present disclosure. In particular, FIG. 2 shows a side view of the hanger 113.

As mentioned above, one or more hangers 113 may be used to suspend one or more floor panels 116 below the platform 106 of the deck 103. The hanger 113 may be constructed of metal, plastic, any other suitable type of material, or any combination thereof. The hanger 113 may comprise a first arm 203, a second arm 206, an overhang support 209, a stop 213, and/or other components. Additionally, a slot 216 and a fastener opening 219 may be formed in the hanger 113.

As shown, the second arm 206 may extend from and be substantially perpendicular to the first arm 203. The overhang support 209 may be an extended section from the portion of the second arm 206 that forms the slot 216. As will be discussed in more detail below, a portion of the floor panel 116 may insert into and be retained in the slot 216. Additionally, a portion of one or more floor panels 116 may be disposed on the overhang support 209, as will also be described in further detail below.

A fastener (not shown) may be inserted into the fastener opening 219 and used to suspend the hanger 113 from the platform 106 or any other suitable structure. As will be described in further detail below, the hanger 113 may pivot about the fastener that is inserted into the fastener opening 219. As shown in FIG. 2, the stop 213 may extend from and be perpendicular to the first arm 203. The stop 213 may contact the fastener to thereby limit the extent to which the hanger 113 may pivot.

Figure 3:
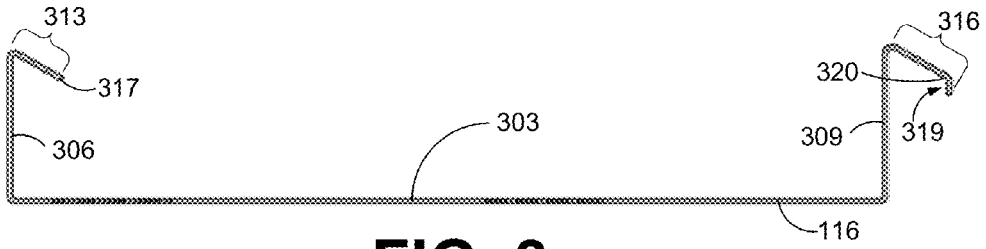
FIG. 3 is a drawing of a floor panel for the deck drainage system of FIG. 1 according to various embodiments of the present disclosure.

With reference to FIG. 3, shown is an example of the floor panel 116 according to various embodiments of the present disclosure. The floor panel 116 may be constructed of various materials, such as metal, plastic, fabric, any other suitable material, and/or any combination thereof. The floor panel 116 may include a floor 303, a first side 306, a second side 309, a first overhang 313, a second overhang 316, and/or other components.

As shown in FIG. 3, the floor 303 may form a substantially flat surface on which liquid that has fallen from the deck 103 may travel. The first side 306 and the second side 309 of the floor panel 116 may function as barriers for the liquid so that the liquid may be channeled in a desired direction along the floor 303. As shown in FIG. 3, the first side 306 and the second side 309 of the floor panel 116 may extend from and may be substantially perpendicular to the floor 303 in various embodiments.

As will be described in further detail below, the first overhang 313 may be disposed directly on the overhang support 209 of the hanger 113. To this end, the first overhang 313 may extend from the first side 306, and a distal edge 317 of the first overhang 313 relative to the first side 306 may extend towards the second side 309. In this configuration, the first overhang 313 extends over a portion of the floor 303. For the embodiment shown in FIG. 3, the angle formed between the first overhang 313 and the first side 306 is approximately 45 degrees. The angle formed between the first overhang 313 and the first side 306 may have various values according to various embodiments.

Similarly, the second overhang 316 may extend from the second side 309. As will be described in more detail below, the second overhang 316 may be disposed directly on the first overhang 313 of another floor panel 116. The distal end 320 of the second overhang 316 relative to the second side 309 may extend away from the first side 306, as shown in FIG. 3. In this configuration, the second overhang 316 extends over a portion of the floor 303 of an adjacent floor panel 116 when the floor panel 116 is installed in the deck drainage system 100.

At the distal end 320 relative to the second side panel 309, the second overhang 316 forms an end section 319 that may be substantially parallel to the second side 309. When the floor panel 116 is installed in the deck drainage system 100, the end section 319 may be substantially vertical. As will be discussed in further detail below, the end section 319 may prevent liquid from being wicked into the region between two floor panels 116 and then dripping from the deck drainage system 100.

Figure 4:
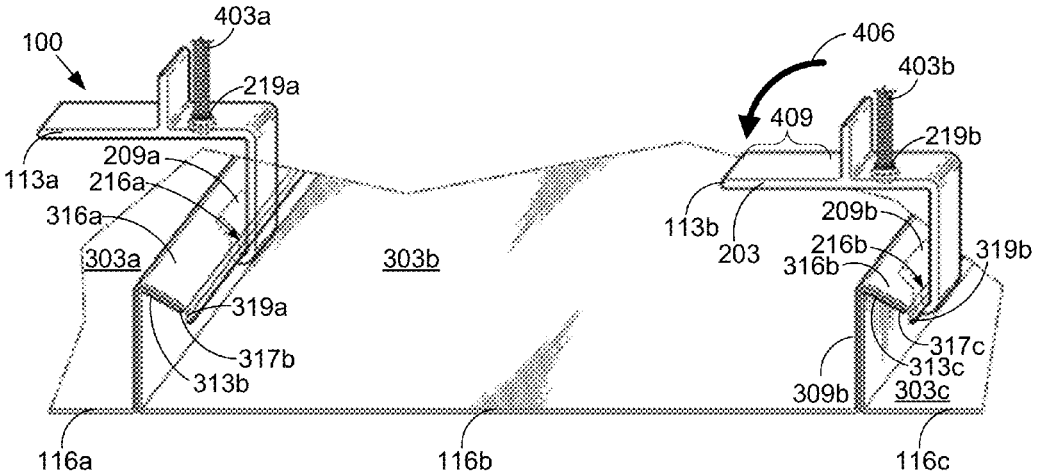
FIG. 4 is a drawing of multiple hangers of FIG. 2 supporting multiple floor panels of FIG. 3 according to various embodiments of the present disclosure.

With reference to FIG. 4, shown are multiple hangers 113, referred to herein as the first hanger 113*a* and the second hanger 113*b*, suspending multiple floor panels 116, referred to herein as the first floor panel 116*a*, the second floor panel 116*b*, and the third floor panel 116*c*.

As shown in FIG. 4, fasteners 403*a*-403*b* have been inserted into the respective fastener openings 219*a*-219*b*. The fasteners 403*a*-403*b* may be attached to the platform 106 of the deck 103 (e.g., decking of the deck) or any other suitable structure to thereby suspend the hangers 113*a*-113*b* beneath the platform 106 of the deck 103.

The first overhang 313*b* of the second floor panel 116*b* may be disposed directly on the overhang support 209*a* of the first hanger 113*a*. Thereafter, the second overhang 316*a* of the first floor panel 116*a* may be disposed directly on the first overhang 313*b* of the second floor panel 116*b*. Additionally, the end section 319*a* of the first floor panel 116*a* may be inserted into the slot 216*a* of the first hanger 113*a*, as shown in FIG. 4. In this way, the first hanger 113*a* may suspend at least a portion of the first floor panel 116*a* and the second floor panel 116*b*.

Similarly, the first overhang 313*c* of the third floor panel 116*c* may be disposed directly on the overhang support 209*b* of the second hanger 113*b*. Thereafter, the second overhang 316*b* of the second floor panel 116*b* may be disposed directly on the first overhang 313*c* of the third floor panel 116*c*. Additionally, the end section 319*b* of the second floor panel 116*b* may be inserted into the slot 216*b* of the second hanger 113*b*, as shown in FIG. 4. In this way, the second hanger 113*b* may suspend at least a portion of the second floor panel 116*b* and the third floor panel 116*c*.

When liquid falls through the platform 106 of the deck 103, the liquid may fall onto the floor panels 116*a*-116*c* and be channeled by the floor panels 116*a*-116*c* to a desired destination. For example, some of the liquid that falls through the platform 106 may fall directly onto the floors 303*a*-303*c*, and gravity may cause the liquid to travel across the floors 303*a*-303*c* towards one or more gutters, downspouts, and/or any other suitable type of conduit for the liquid.

Some of the liquid that falls from the platform 106 may fall directly onto the second overhangs 316*a*-316*b* of the floor panels 116*a*-116*b*. In such a case, gravity may cause the liquid to travel downward along the second overhangs 316*a*-316*b* towards the end sections 319*a*-319*b*. The liquid may then travel downward along the end sections 319*a*-319*b* of the second overhangs 316*a*-316*b*. Thereafter, the liquid may fall from the end sections 319*a*-319*b* directly onto the floors 303*b*-303*c* of the floor panels 116*b*-116*c*. After the liquid falls onto the floors 303*b*-303*c*, gravity may cause the liquid to travel across the floors 303*b*-303*c* towards one or more gutters, downspouts, and/or any other suitable type of conduit for the liquid.

Because the second overhangs 316*a*-316*b* may be disposed directly on the first overhangs 313*b*-313*c*, respectively, liquid could be wicked between the first overhangs 313*b*-313*c* and second overhangs 316*a*-316*b*. In this regard, capillary action could cause liquid to move into the relatively small space between the first overhangs 313*b*-313*c* and the second overhangs 316*a*-316*b*, respectively, and eventually fall from the deck drainage system 100. However, the end sections 319*a*-319*b* of the second overhangs 316*a*-316*b* may cover the distal edges 317*b*-317*c* of the first overhangs 313*b*-313*c* to thereby prevent water from being wicked between the first overhangs 313*b*-313*c* and the second overhangs 316*a*-316*b*. Specifically, because the end sections 319*a*-319*b* of the second overhangs 316*a*-316*b* cover the distal edges 317*b*-317*c* of the first overhangs 313*b*-313*c*, respectively, liquid may travel down the second overhangs 316*a*-316*b* and fall directly onto the floors 303*b*-303*c* before having the opportunity to be wicked between the floor panels 116*a*-116*c*. Thus, because the end sections 319*a*-319*b* cover the distal edges 317*b*-317*c* of the first overhangs 313*b*-313*c*, respectively, the end sections 319*a*-319*b* may prevent liquid from being wicked between the floor panels 116*a*-116*c* and then falling from the deck drainage system 100.

For various reasons, it may be desirable to remove and/or replace one or more of the floor panels 116*a*-116*c* from the deck drainage system 100. Various embodiments of the present disclosure may facilitate such removal and/or replacement as will now be described.

To begin the process of removing the second floor panel 116*b*, a user may move the second floor panel 116*b* vertically upward, so that the end section 319*b* of the second overhang 316*b* is removed from the slot 216*b* formed by the second hanger 113*b*. Additionally, the user may move the third floor panel 116*c* vertically upward, or toward the platform 106 of the deck 103. When the weight of the second floor panel 116*b* and the third floor panel 116*c* have been removed from the second hanger 113*b*, the second hanger 113*b* may pivot about the fastener 403*b* in the direction indicated by the arrow 406. In particular, the weight of the portion 409 of the first arm 203 may cause the second hanger 113*b* to rotate in the direction indicated by the arrow 406. Because the second hanger 113*b* may rotate in the direction indicated by the arrow 406, the overhang support 209*b* of the second hanger 113*b* may move away from the second overhang 316*b* of the second floor panel 116*b*. As a result, the second side 309 and the second overhang 316*b* of the second floor panel 116*b* may be lowered without being obstructed by the second hanger 113*b*. The second overhang 316*a* of the first floor panel 116*a* and the first overhang 313*b* of the second floor panel 116*b* may be separated from the first hanger 113*a* using the process described above, and the second floor panel 116*b* may be lowered. Thereafter, the second floor panel 116*b* may be reinstalled or replaced.

Figure 5:
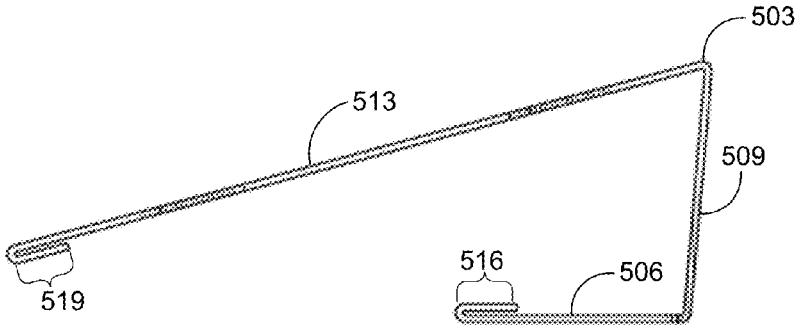
FIG. 5 is a drawing of a wall panel for the deck drainage system of FIG. 1 according to various embodiments of the present disclosure.

With reference to FIG. 5, shown is a side view of a wall panel 503 for the deck drainage system 100 according to various embodiments of the present disclosure. The wall panel 503 may be installed along an edge of the deck drainage system 100. For example, one or more wall panels 503 may be installed along an edge of the deck drainage system 100 that abuts a building structure. As will be described in further detail below, the wall panel 503 may be configured to clamp itself onto one or more floor panels 116 of the deck drainage system 100.

The wall panel 503 may comprise a floor 506, a side 509, an overhang 513, and/or other components. As will be discussed in further detail below, the floor 506 of the wall panel 503 is configured to be disposed directly beneath the floor 303 of one or more floor panels 116. The floor 506 of the wall panel 503 may comprise a floor hem 516. The floor hem 516 may be a portion of the floor 506 that has been folded over onto itself. As shown, the floor hem 516 may form an edge of the wall panel 503.

As shown in FIG. 5, the side 509 of the wall panel 503 may extend from the floor 506. The angle formed between the side 509 and the floor 506 of the wall panel 503 in the embodiment shown in FIG. 5 is greater than 90°. In alternative embodiments, the angle formed between the side 509 and the floor 506 may be varied.

As shown in FIG. 5, the overhang 513 may extend from the side 509 of the wall panel 503. The overhang 513 may form a surface on which liquid that has fallen from the deck 103 may travel. When installed in the deck drainage system 100, liquid may travel downward along the overhang 513. As such, the angle formed between the side 509 and the overhang 513 is less than 90°. However, the angle formed between the side 509 and the overhang 513 may have different values in alternative embodiments.

The overhang 513 of the wall panel 503 may comprise an overhang hem 519. The overhang hem 519 may be a portion of the overhang 513 that has been folded over onto itself. The overhang hem 519 may form an edge of the wall panel 503. The overhang hem 519 may prevent liquid from being wicked between the wall panel 503 and one or more floor panels 116 or other components in the deck drainage system 100.

Figure 6:
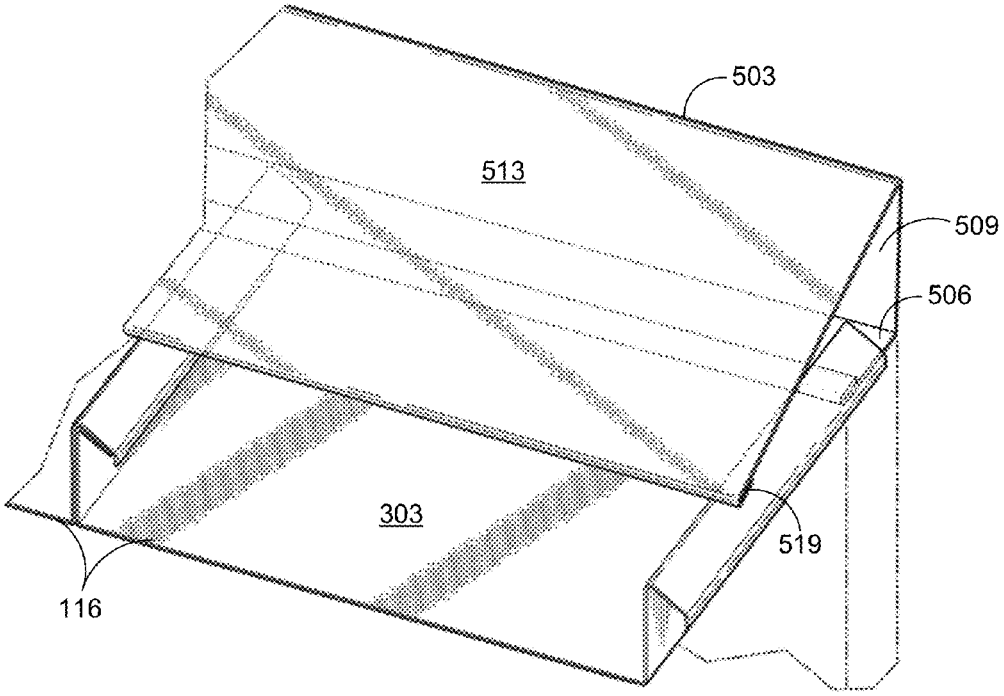
FIG. 6 is a drawing of the wall panel of FIG. 5 attached to multiple floor panels of FIG. 3 according to various embodiments of the present disclosure.

With reference to FIG. 6, shown is the wall panel 503 attached to multiple floor panels 116 according to various embodiments of the present disclosure. To install the wall panel 503 in the deck drainage system 100, the wall panel 503 may be slidably attached to one or more floor panels 116. In this regard, the floor 506 of the wall panel 503 may be disposed directly beneath the floor 303 of the floor panel 116, and the overhang hem 519 of the wall panel 503 may be disposed directly on the floor panels 116 as shown in FIG. 6. Thereafter, the wall panel 503 may be pushed so that the side 509 of the wall panel 503 contacts the floor panels 116. When the wall panel 503 is not installed in the deck drainage system 100, the vertical distance between the floor 506 and the lowest point of the overhang 513 may be less than the vertical height of the floor panel 116. As such, the act of sliding the wall panel 503 over one or more floor panels 116 may cause the wall panel 503 to clamp itself onto the one or more floor panels 116. In this way, the wall panel 503 may be attached to one or more floor panels 116.

When the wall panel 503 is installed in the deck drainage system 100, liquid may fall from the deck 103 directly onto the overhang 513. The liquid may then travel along the overhang 513 towards the overhang hem 519. The liquid may then fall from the overhang 513 directly onto the floor 303 of one or more floor panels 116, and the one or more floor panels 116 may channel the liquid to a desired destination.

The overhang hem 519 may prevent the liquid from being wicked between the wall panel 503, one or more floor panels 116, and/or other components in the deck drainage system 100. As such, the wall panel 503 may prevent liquid from leaking from the deck drainage system 100. Additionally, the distance along the overhang 513 between the overhang hem 519 and the side 509 of the wall panel 503 is relatively long. As such, it may be unlikely that liquid that falls from the overhang 513 onto the floor 303 is able to splash back over the side 509 of the wall panel 503.

The above-described embodiments of the present disclosure are merely examples of implementations to set forth a clear understanding of the principles of the disclosure. Many variations and modifications may be made to the above-described embodiments without departing substantially from the spirit and principles of the disclosure. All such modifications and variations are intended to be included herein within the scope of this disclosure and protected by the following claims.

Therefore, the following is claimed:

1. A deck drainage system, comprising:

a floor panel configured to be positioned under a deck platform, wherein the floor panel is configured to channel liquid that falls from the deck platform, wherein the floor panel comprises:

a floor;

a side that extends from the floor of the floor panel; and an overhang that extends from the side, wherein the overhang comprises an end section, wherein the overhang is configured to be disposed over another overhang of another floor panel, wherein the end section is configured to be adjacent to a distal edge of the other overhang; and a hanger configured to be suspended from the deck platform, wherein the hanger forms a slot into which the end section of the overhang of the floor panel is configured to be inserted.

2. The deck drainage system of claim 1, wherein an angle formed between the overhang and the side is approximately 45 degrees.

3. The deck drainage system of claim 1, wherein the end section of the overhang of the floor panel is configured to be substantially vertical.

4. The deck drainage system of claim 1, further comprising a fastener that is configured to suspend the hanger from the deck platform.

5. The deck drainage system of claim 4, wherein the hanger is configured to pivot about the fastener.

6. The deck drainage system of claim 1, wherein the hanger further comprises a stop that is configured to limit a pivot amount of the hanger.

7. The deck drainage system of claim 1, wherein the hanger further comprises:

a first arm; and a second arm that is substantially perpendicular to the first arm.

8. The deck drainage system of claim 7, wherein the hanger further comprises an overhang support that extends from the second arm, wherein the overhang of the floor panel is configured to be disposed over the overhang support.

9. The deck drainage system of claim 8, further comprising a wall panel slidably attached to the floor panel, wherein the wall panel comprises a wall panel overhang that facilitates at least a portion of the liquid being channeled to the floor panel, wherein an edge of the wall panel overhang comprises a hem.

10. A floor panel for a deck drainage system, the floor panel comprising:

a floor;

a side that extends from the floor; and an overhang that extends from the side, wherein the overhang comprises an end section, wherein the overhang is configured to be disposed over another overhang of another floor panel, wherein the end section is configured to be adjacent to a distal edge of the other overhang, wherein the end section is configured to be substantially vertical when suspended from a hanger, wherein the end section is configured to be inserted into a slot formed in the hanger.

11. The floor panel of claim 10, wherein an angle formed between the overhang and the side is approximately 45 degrees.

12. The floor panel of claim 10, further comprising an additional side that extends from the floor; and wherein the overhang extends away from the additional side.

13. The floor panel of claim 10, wherein the hanger is configured to suspend the floor panel below a deck platform, the hanger comprising:

a first arm, wherein a fastener is configured to be inserted into an opening formed in the first arm; and a second arm that extends from the first arm, wherein the second arm forms the slot for the end section of the overhang.

14. The floor panel of claim 13, wherein the hanger further comprises an overhang support that extends from the second arm, wherein the overhang of the floor panel is configured to be disposed over the overhang support of the hanger.

15. The floor panel of claim 13, wherein the hanger is configured to pivot about the fastener when the fastener is inserted into the opening of the first arm.

16. The floor panel of claim 15, wherein the hanger further comprises a stop that extends from the first arm, wherein the stop is configured to limit a pivot amount of the hanger.

17. The floor panel of claim 16, wherein the stop is substantially perpendicular to the first arm.

* * * * *